US006039036A

United States Patent [19]

Padilla

[11] Patent Number: 6,039,036

[45] Date of Patent: Mar. 21, 2000

[54] ARROW REST HAVING BALL CONTACT BEARINGS

[76] Inventor: Mark D. Padilla, 5102 Bitterweed Ln., Colorado Springs, Colo. 80917

[21] Appl. No.: 09/132,586

[22] Filed: Aug. 11, 1998

[51] Int. Cl.[7] ..... F41B 5/22

[52] U.S. Cl. ..... 124/44.5

[58] Field of Search ..... 124/24.1, 44.5

[56] References Cited

U.S. PATENT DOCUMENTS

| | | | |
|---|---|---|---|
| 5,031,601 | 7/1991 | Gunter | 124/44.5 |
| 5,085,201 | 2/1992 | Tepper et al. | 124/44.5 |
| 5,261,383 | 11/1993 | Halamay | 124/44.5 |
| 5,462,041 | 10/1995 | Solecki | 124/44.5 |

*Primary Examiner*—John A. Ricci
*Attorney, Agent, or Firm*—G. F. Gallinger

[57] ABSTRACT

An efficient and quiet arrow rest which has bearings at the points of contact with an arrow. The arrow rest for use on a bow with an arrow comprising: a bracket for attachment to a central side portion of the bow, said bracket having an projecting end portion; two arms, one projecting upwardly and away from the bow, and the other projecting upwardly and towards the bow, each carried by the projecting end portion; and two race members, each carried on and above an arm member and each having; a ball bearing rotatably positioned therein. In use the arrow is seated on the bearings when the bow is drawn so that the bearings rotate when the arrow is released.

6 Claims, 1 Drawing Sheet

ARROW REST HAVING BALL CONTACT BEARINGS

FIELD OF INVENTION

This invention relates to arrow rests used in bows. More particularly this invention relates to an improved arrow rest having bearings at the points of contact with an arrow.

BACKGROUND OF THE INVENTION

Archers, unlike hunters who use fire arms, do everything possible to maximize the speed and minimize the noise of their arrows. They frequently must shoot from their maximum range. Their maximum shooting range is about 70 yards. At this distance the target animal may hear any noise they make. Even if they are absolutely still and quiet the target animal may "jump the string". Elks frequently hear the arrow discharging from the bow and run away, before the arrow reaches where they were standing. There is a need for an arrow rest which is more efficient and quieter.

OBJECTS AND STATEMENT OF INVENTION

It is an object of this invention to disclose an improved arrow rest which minimizes friction and thereby increases range and power. It is yet a further object of this invention to disclose an arrow rest which is quieter in operation than conventional arrow rests.

One aspect of this invention provides for an arrow rest for use on a bow with an arrow comprising: a bracket for attachment to a central side portion of the bow, said bracket having an projecting end portion; two arms, one projecting upwardly and away from the bow, and the other projecting upwardly and towards the bow, each carried by the projecting end portion; two race members, each carried on and above an arm member; and each having; a ball bearing rotatably positioned therein; wherein use the arrow is seated on the bearings when the bow is drawn so that the bearings rotate when the arrow is released.

Another aspect of this invention provides for an arrow rest as above wherein the race members are hingably attached to an upper end portion of the arms to further facilitate arrows having different shaft diameters.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

BRIEF DESCRIPTION OF THE DRAWINGS

The invention will be better understood and objects other than those set forth will become apparent to those skilled in the art when consideration is given to the following detailed description thereof. Such description makes reference to the annexed drawings wherein.

DETAILED DESCRIPTION OF THE INVENTION

Figure 2:
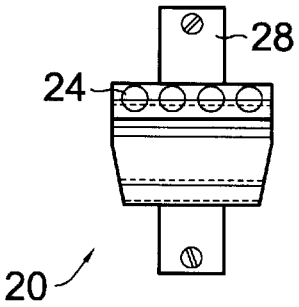
FIG. 2 is a side of the arrow rest shown in FIG. 1 as viewed along line 2—2.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

Figure 1:
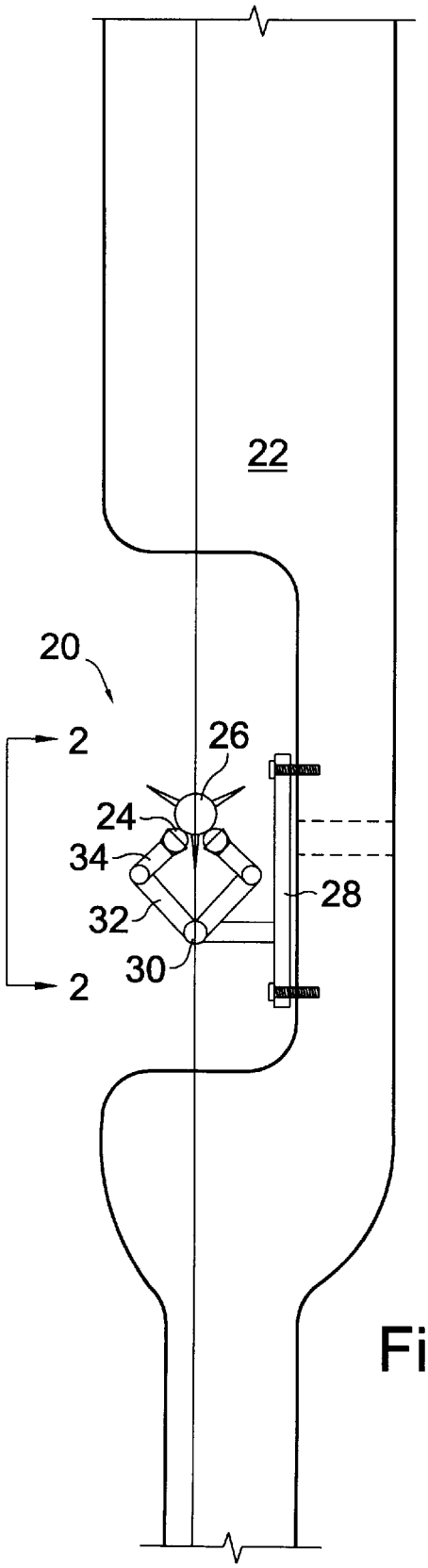
FIG. 1 is a partial rear view of a bow and an arrow rest having contact bearings.

Turning now to the drawings and more particularly to FIG. 1 we have a partial rear view of a bow 22 and an arrow rest 20 having contact bearings 24. FIG. 2 is a side of the arrow rest 20 shown in FIG. 1 as viewed along line 2—2. The arrow rest 20 for use on a bow 22 with an arrow 26 comprises: a bracket 28 for attachment to a central side portion of the bow 22, said bracket 28 having a projecting end portion 30; two arms 32, one projecting upwardly and away from the bow 22, and the other projecting upwardly and towards the bow 22, each carried by the projecting end portion 30; and, two race members 34, each carried on and above an arm 32; and each having; a bearing 24 rotatably positioned therein. In use the arrow 26 is seated on the bearings 24 when the bow 22 is drawn so that the bearings 24 rotate when the arrow 26 is released.

In the preferred embodiment one of the arms 32 is hingably attached to the projecting end portion 30 of the bracket 28 in order to accommodate arrows 26 having different shaft diameters. The race members 34 are hingably attached to an upper end portion of the arms 32 to further facilitate arrows 26 having different shaft diameters. In the most preferred embodiment both arms 32 are hingably carried and the arrow rest 20 is fabricated from plastic which is most preferably nylon. Most preferably each race member carries four ball bearings which are in parallel alignment with the a shaft of the arrow 26.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. An arrow rest for use on a bow with an arrow comprising:

a bracket for attachment to a central side portion of the bow, said bracket having a projecting end portion;

two arms, one projecting upwardly and away from the bow, and the other projecting upwardly and towards the bow, each carried by the projecting end portion;

two race members, each carried on and above an arm; and each having a ball bearing rotatably positioned therein;

wherein in use the arrow is seated on the ball bearings when the bow is drawn so that the bearings rotate when the arrow is released.

2. An arrow rest as in claim 1 wherein one of the arms is hingably attached to the projecting end portion of the bracket in order to accommodate arrows having different shaft diameters.

3. An arrow rest as in claim 1 wherein the race members are hingably attached to an upper end portion of the arms to further facilitate arrows having different shaft diameters.

4. An arrow rest as in claim 3 wherein the arrow rest is fabricated from plastic.

5. An arrow rest as in claim 1 wherein each race member carries bearings in parallel alignment to the shaft of the arrow.

6. A bracket as in claim 5 wherein there are four bearings in each race member.

* * * * *